US009548541B2

(12) United States Patent
Djerafi et al.

(10) Patent No.: US 9,548,541 B2
(45) Date of Patent: Jan. 17, 2017

(54) APPARATUS AND METHOD FOR A HIGH APERTURE EFFICIENCY BROADBAND ANTENNA ELEMENT WITH STABLE GAIN

(71) Applicant: Huawei Technologies Canada Co., Ltd., Kanata (CA)

(72) Inventors: Tarek Djerafi, Montreal (CA); Ke Wu, Montreal (CA); Ajay Babu Guntupalli, Munich (DE); Kuangda Wang, Montreal (CA)

(73) Assignee: HUAWEI TECHNOLOGIES CANADA CO., LTD., Kanata (CA)

( * ) Notice: Subject to any disclaimer, the term of this patent is extended or adjusted under 35 U.S.C. 154(b) by 138 days.

(21) Appl. No.: 14/673,601

(22) Filed: Mar. 30, 2015

(65) Prior Publication Data

US 2016/0294066 A1 Oct. 6, 2016

(51) Int. Cl.
*H01Q 13/10* (2006.01)
*H01Q 19/28* (2006.01)
*H01Q 21/06* (2006.01)

(52) U.S. Cl.
CPC ..... *H01Q 13/106* (2013.01); *H01Q 19/28* (2013.01); *H01Q 21/064* (2013.01)

(58) Field of Classification Search
CPC ..... H01Q 13/106; H01Q 19/28; H01Q 21/06
USPC ..... 343/770
See application file for complete search history.

(56) References Cited

U.S. PATENT DOCUMENTS 4,070,676 A 1/1978 Sanford et al.
5,025,264 A * 6/1991 Stafford ..... H01Q 13/18 343/767
5,121,127 A * 6/1992 Toriyama ..... H01Q 9/0414 343/700 MS
6,064,350 A * 5/2000 Uchimura ..... H01P 3/121 343/700 MS
6,496,147 B1 * 12/2002 Kirino ..... H01Q 3/26 333/156
6,779,730 B2 * 8/2004 Fletout ..... G06K 19/07745 235/492
8,723,732 B2 * 5/2014 Lee ..... H01Q 1/2283 343/700 MS
2008/0042917 A1 2/2008 Seki et al.
2011/0316734 A1 12/2011 Svensson et al.
(Continued)

FOREIGN PATENT DOCUMENTS

JP 2001068924 A 3/2001
JP 2012147243 A 8/2012

*Primary Examiner* — Huedung Mancuso
(74) *Attorney, Agent, or Firm* — Slater Matsil, LLP

(57) ABSTRACT

Embodiments are provided for an antenna element design with high aperture efficiency and stable gain across a frequency range. In an embodiment, the antenna element is obtained by placing a conductive layer on a dielectric substrate, forming a slot in the conductive layer, and forming two feed lines inside the dielectric substrate. A dielectric layer is placed on the dielectric substrate and over the conductive layer and the slot. A circular or elliptical conductive wall is formed inside the dielectric layer. A conductive element is also formed on the dielectric layer and over the slot. One or more second dielectric layers are placed on the dielectric layer and over the conductive element. A second circular or elliptical conductive wall is formed inside each second dielectric layer. A second conductive element is also formed on each second dielectric layer, over the conductive element.

21 Claims, 9 Drawing Sheets

(56) References Cited

U.S. PATENT DOCUMENTS

2015/0084830 A1 3/2015 Elsherbini

* cited by examiner

APPARATUS AND METHOD FOR A HIGH APERTURE EFFICIENCY BROADBAND ANTENNA ELEMENT WITH STABLE GAIN

TECHNICAL FIELD

The present invention relates to antenna design, and, in particular embodiments, to an apparatus and method for obtaining a high aperture efficiency broadband antenna element with stable gain.

BACKGROUND

Radiators with high aperture efficiency and low cross-polarization levels are desired aspects to achieve wide-band or multi-beam antenna design for modern telecommunications. It is desirable that the antenna size of such designs be compact and planar with respect to system integration, for example in antenna array structures. In the antenna array, there is a need to reduce antenna size and increase the antenna gain (e.g., in terms of efficient radiation of energy in the desired direction) to achieve the highest aperture efficiency for each antenna element in the array. In an antenna array, mutual coupling between the antenna elements typically diverts antenna power into unwanted side-lobe radiation patterns, which can reduce the gain of the antenna array.

SUMMARY OF THE INVENTION

In accordance with an embodiment, an antenna element structure comprises a dielectric substrate, a conductive layer on the dielectric substrate and two feed lines inside the dielectric substrate. The two feed lines are in contact with the conductive layer and connected to a ground at a bottom of the substrate. The antenna element further comprises a slot in the conductive layer exposing a surface of the dielectric substrate. The slot is positioned between the two feed lines. The antenna element also comprises a dielectric layer on the dielectric substrate covering the conductive layer and the slot, and a conductive element on the dielectric layer. The conductive element is positioned over the slot and between the feed lines. The antenna element further comprises a conductive wall inside the dielectric layer and surrounding the conductive element. The conductive wall has a height equal to a thickness of the dielectric layer. One or more second dielectric layers are further placed on the dielectric layer. The one or more dielectric layers cover the conductive element and the conductive wall. A second conductive element is positioned on each second dielectric layer over the conductive element. Also included inside each second dielectric layer, a second conductive wall surrounding the conductive element and having a height equal to a thickness of the second dielectric layer.

In accordance with another embodiment, an antenna array structure comprises a dielectric substrate and an array of adjacent antenna elements on the dielectric substrate. Each antenna elements comprises a conductive layer on the dielectric substrate and two feed lines inside the dielectric substrate. The two feed lines are in contact with the conductive layer and connected to a ground at a bottom of the substrate. The antenna element further comprises a slot in the conductive layer exposing a surface of the dielectric substrate. The slot is positioned between the two feed lines. The antenna element also comprises a dielectric layer on the dielectric substrate covering the conductive layer and the slot, and a conductive element on the dielectric layer. The conductive element is positioned over the slot and between the feed lines. The antenna element further comprises a conductive wall inside the dielectric layer and surrounding the conductive element. The conductive wall has a height equal to a thickness of the dielectric layer. One or more second dielectric layers are further placed on the dielectric layer. The one or more dielectric layers cover the conductive element and the conductive wall. A second conductive element is positioned on each second dielectric layer over the conductive element. Also included inside each second dielectric layer, a second conductive wall surrounding the conductive element and having a height equal to a thickness of the second dielectric layer.

In accordance with yet another embodiment, a method for making an antenna element includes placing a conductive layer on a dielectric substrate, forming a slot in the conductive layer which exposes the dielectric substrate, forming two feed lines inside the dielectric substrate, and connecting the two feed lines to the conductive layer and a ground. The method further includes placing a dielectric layer on the dielectric substrate and over the conductive layer and the slot, forming a circular or elliptical conductive wall inside the dielectric layer, and forming a conductive element on the dielectric layer and over the slot. Additionally, one or more second dielectric layers are placed on the dielectric layer and over the conductive element. A second circular or elliptical conductive wall is formed inside each second dielectric layer. A second conductive element is also formed on each second dielectric layer over the conductive element.

The foregoing has outlined rather broadly the features of an embodiment of the present invention in order that the detailed description of the invention that follows may be better understood. Additional features and advantages of embodiments of the invention will be described hereinafter, which form the subject of the claims of the invention. It should be appreciated by those skilled in the art that the conception and specific embodiments disclosed may be readily utilized as a basis for modifying or designing other structures or processes for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following description taken in conjunction with the accompanying drawings, in which.

Corresponding numerals and symbols in the different figures generally refer to corresponding parts unless otherwise indicated. The figures are drawn to clearly illustrate the relevant aspects of the embodiments and are not necessarily drawn to scale.

DETAILED DESCRIPTION OF ILLUSTRATIVE EMBODIMENTS

The making and using of the presently preferred embodiments are discussed in detail below. It should be appreciated, however, that the present invention provides many applicable inventive concepts that can be embodied in a wide variety of specific contexts. The specific embodiments discussed are merely illustrative of specific ways to make and use the invention, and do not limit the scope of the invention.

Figure 1:
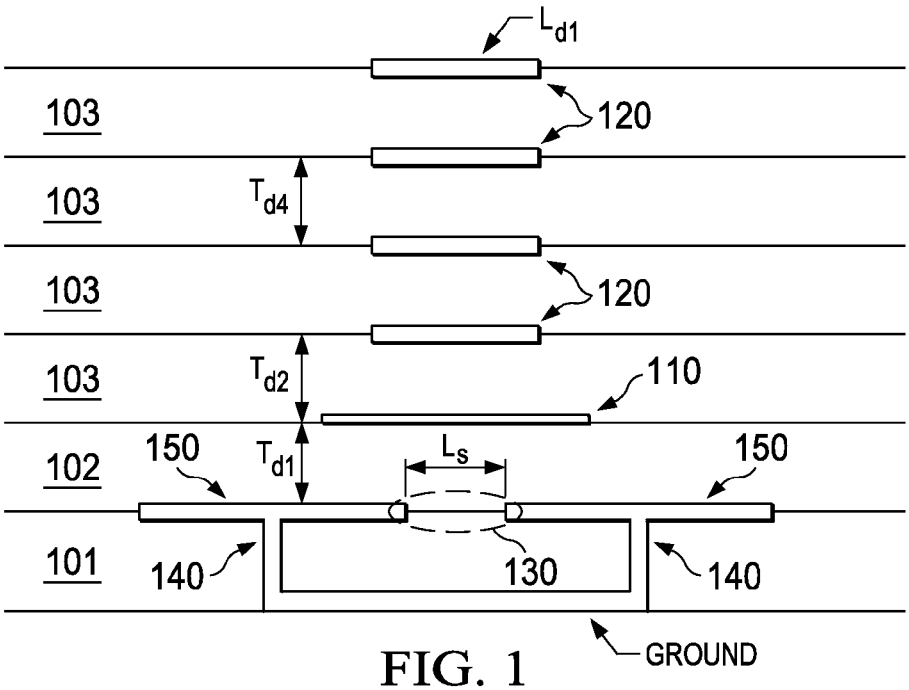
FIG. 1 shows a cross-sectional side view of a multi-layer antenna element according to a Yagi configuration.
Figure 2A:
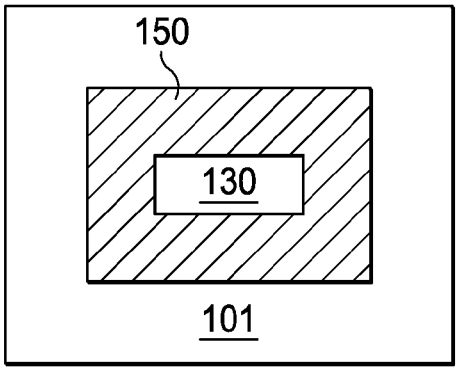
FIG. 2A shows a plan view of the surface of a dielectric substrate of the antenna element in FIG. 1.
Figure 2B:
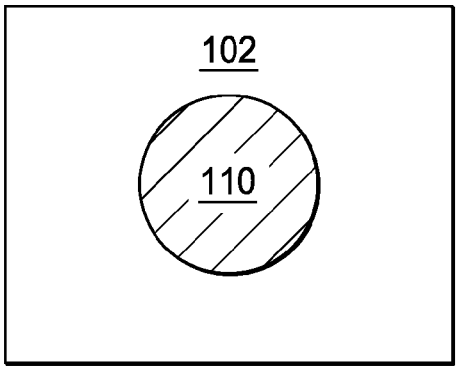
FIG. 2B shows a plan view of the surface of a dielectric layer of the antenna element in FIG. 1.
Figure 2C:
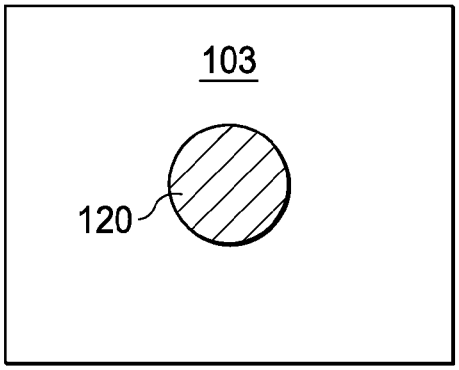
FIG. 2C shows a plan view of the surface of an additional dielectric layer of the antenna element in FIG. 1.

FIG. 1 illustrates a cross-sectional side view of a multi-layer layer antenna element 100 in a conventional configuration, referred to as a Yagi configuration. The thickness of the antenna is multiple of $\kappa_r/4$, where $\kappa_r$ is the wavelength at the resonance frequency of the antenna. The resonance frequency of the antenna can be chosen according to the antenna application, and can be one of the operating frequencies for the application. In this example, the antenna element 100 includes six stacked dielectric layers (numbered 1 to 6 in the figure), including a dielectric substrate 101 (layer 1), a first dielectric layer 102 (layer 2) on top of the dielectric substrate 101, and four additional dielectric layers 103 (layers 3 to 6) on the dielectric layer 102. In general, the multi-layer antenna element 100 includes two or more dielectric layers over the dielectric substrate. FIG. 2A shows a plan view of the surface of the dielectric substrate 101. FIG. 2B shows a plan view of the surface of the dielectric layer 102. FIG. 2C shows a plan view of the surface of a dielectric layer 103.

In the antenna element 100, a conductive (e.g., metallic) layer 150 is placed on the surface of the dielectric substrate 101. The conductive layer 150 covers a portion of the surface of the dielectric substrate 101. Two conductive feed lines 140, below and in contact with the conductive layer 150, extend inside the dielectric layer 101. The feed lines 140 can be connected electrically to an energy source (not shown) and grounded at the bottom of the dielectric substrate 101. A slot 130 is formed in the conductive layer 150 between the feed lines 140. The slot 130 is an opening in the conductive layer 150 that exposes the surface of the dielectric layer 101. The slot 130 is a rectangular slot with a length, $L_d$, chosen to optimize the antenna radiation criteria. For example, $L_s$ can be about a tenth of a wavelength at the low end of the frequency band of the antenna radiation.

The dielectric layer 102 on the dielectric substrate 101 covers the conductive layer 150 and the slot 130. A driven element 110, which is a circular conductive patterned structure, is formed on the first dielectric layer 102. The driven element 110 is positioned over the slot 130, between the feed lines 140. When electric energy (in the form of current or voltage) is applied to the feed lines 140, the slot 130 allows some of that energy to be transferred to the driven element 110. This is referred to as energy coupling between the feed lines 140 and the driven element 110. The coupled energy causes the driven element 110 to radiate and hence emit a radiation pattern.

A dielectric layer 103 on the first dielectric layer 102 covers the driven element 110. A director element 120 is placed on the dielectric layer 103. Similarly to the driven element 110, the director element 120 is a circular conductive patterned structure. An director element 120 is placed on each of the dielectric layers 103 as shown. The director elements 120 may have about the same dimensions (thickness and diameter). However, the director element 120 may have different dimensions (thickness and diameter) than the driven element 110. The director elements 120 are positioned over the driven element 110, such that the centers of the director elements 120 and the driven element 110 are approximately aligned over one another. The diameter of the driven element 110 or director element 120 in the layer i is labeled $L_{di}$. The diameters are chosen to optimize the antenna radiation criteria. The radiation provided by the driven element 110 is directed by the director elements 120 (four director elements in this example) outside the antenna element 100.

In the antenna element 100, the dielectric layer 102 and the additional dielectric layers 103 may be of the same dielectric material. The thickness of the layers may be similar or may vary depending on the antenna application. For instance, the dielectric layer 102 has a thickness of $T_{d1}$, and the additional dielectric layers 103 may have different thicknesses, e.g., $T_{d2}$ may not be equal to $T_{d4}$. In general, $T_{di}$ is the thickness of layer i+1 (where i=1 for the dielectric layer 102). The thicknesses of the layers are chosen to optimize antenna radiation criteria, such as the radiation pattern, energy level, and/or bandwidth.

Figure 3A:
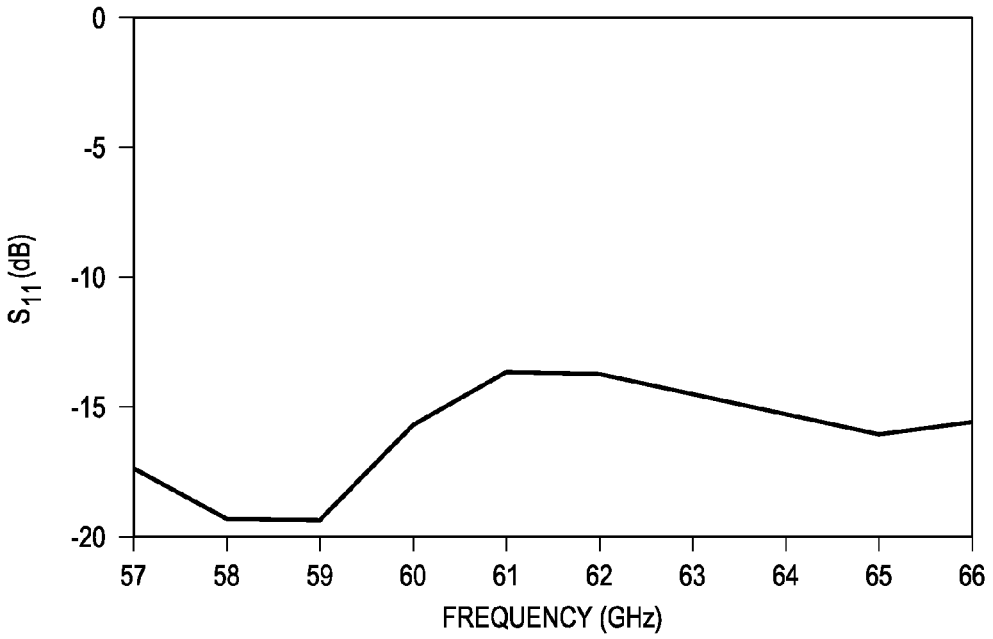
FIG. 3A is a plot of gain versus frequency in a vertical radiation plane of the antenna element in FIG. 2.
Figure 3B:
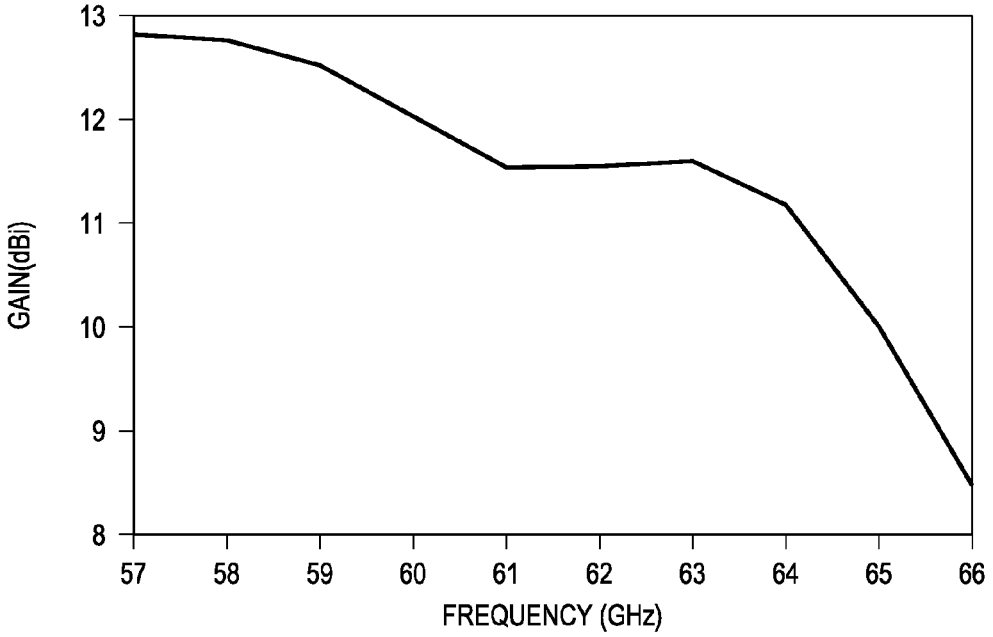
FIG. 3B is a plot of total gain versus frequency of the antenna element in FIG. 2.

FIG. 3A illustrates an example of gain (in dB) versus frequency (in GHz) behavior in a vertical radiation plane (S(1,1)) of the antenna element 100. FIG. 3B illustrates an example of total gain (in dBi) versus frequency behavior of the same antenna design. In comparison to single layer antenna designs, the multi-layer antenna design increases the antenna gain and isolates losses generated by the feed network in the overall antenna performance. However, to overcome the limitation of narrow bandwidth caused by the driven and director elements, thick dielectric layers relative to the operating wavelengths are needed. The relatively thick layers are undesirable since they cause propagation of surface waves, or lateral waves, which increase the coupling between adjacent antenna elements in an array configuration and reduce the radiation efficiency in the intended (forward) direction.

Various embodiments are provided herein for an antenna element design with high aperture efficiency in terms of efficient radiation energy in the desired direction. The antenna element also has stable gain, i.e., similar gain across a desired frequency range, and broadband capability. The antenna element can be part of an array of adjacent similar antenna elements that form the entire antenna structure. The high aperture efficiency reduces mutual coupling between the antenna elements in the array and improves overall antenna gain. The antenna element comprises a plurality of conductor (e.g., metal) elements formed inside dielectric layers. The elements are surrounded by conducting (e.g., metallic) walls also formed inside the layers. The walls may or may not have the same dimensions, such as depth and diameter. In embodiments, the walls may also have circumferential ridges protruding at edges of the walls. In embodiments, a relatively thick dielectric layer or a relatively thin high permittivity layer, with respect to operating wavelengths of the antenna, is placed on top of the dielectric layers to improve performance. The various design aspects of the antenna element are described in detail below.

Figure 4:
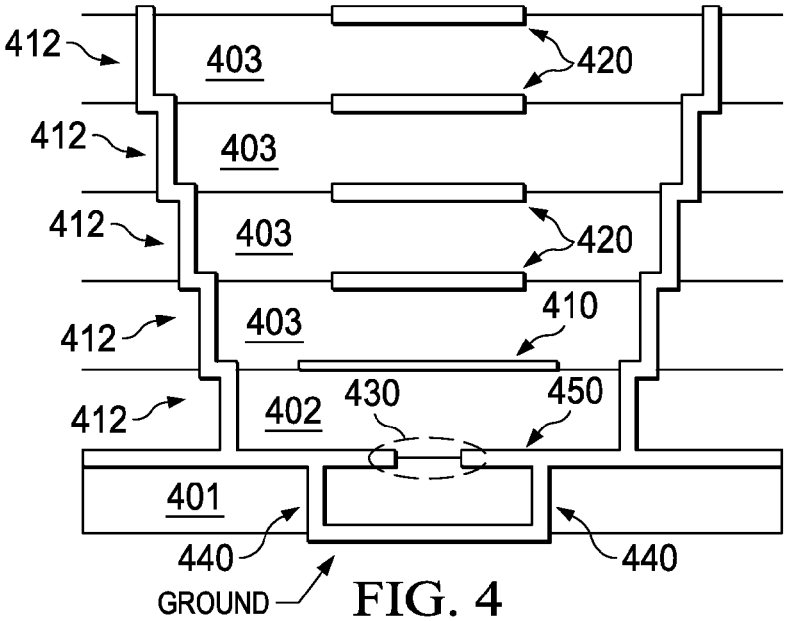
FIG. 4 shows a cross-sectional side view of an embodiment of a multi-layer antenna element.
Figure 5A:
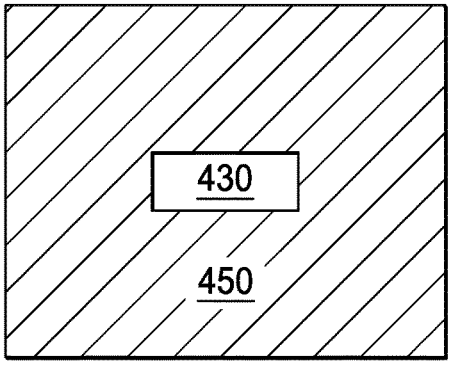
FIG. 5A shows a plan view of the surface of a dielectric substrate of the antenna element in FIG. 4.
Figure 5B:
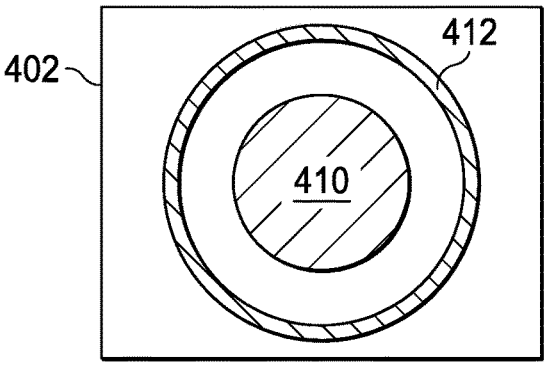
FIG. 5B shows a plan view of the surface of a dielectric layer of the antenna element in FIG. 4.
Figure 5C:
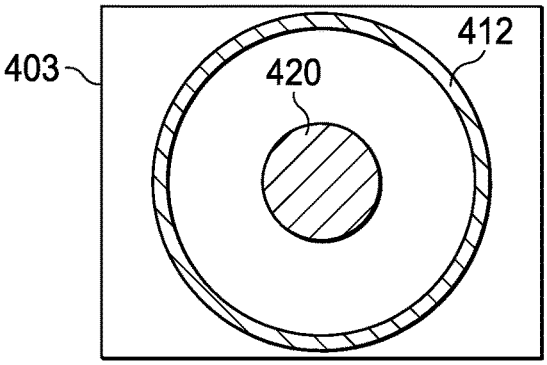
FIG. 5C shows a plan view of the surface of an additional dielectric layer of the antenna element in FIG. 4.

FIG. 4 shows a cross-sectional side view of a multi-layer antenna element 400 according to an embodiment. In this antenna design, surface or lateral waves in the antenna layers that could cause degradation in performance are suppressed in this design. The antenna element 400 includes six stacked dielectric layers including a dielectric substrate 401, a first dielectric layer 402 on top of the dielectric substrate 401, and four additional dielectric layers 403 on the dielectric layer 402. FIG. 5A shows a plan view of the surface of the dielectric substrate 401. FIG. 5B shows a plan view of the surface of the dielectric layer 402. FIG. 5C shows a plan view of the surface of a dielectric layer 403.

A conductive (e.g., metallic) layer 450 is placed on the surface of the dielectric substrate 401. The conductive layer 450 may cover the entire surface of the dielectric substrate 401 (as shown in FIG. 5A) or a portion of the surface. Two feed lines 440, below and in contact with the conductive layer 150, extend in inside the dielectric layer 401. The feed lines 440 are connected to a ground at the bottom of the dielectric substrate 401. A slot 430 in the conductive layer 450 is positioned between the feed lines 440.

The first dielectric layer 402 on the dielectric substrate 401 covers the conductive layer 450 and the slot 430. A driven element 410, which is a circular conductive patterned structure, is formed on the first dielectric layer 402. The driven element 410 is positioned over the slot 430, between the feed lines 440. As in the case of the driven element 110, the driven element 410 radiates with energy coupled from the feeding lines 440, thus emitting antenna radiation. Additionally, a circular conductive (e.g., metallic) wall 412 is formed inside the dielectric layer 402 around the driven element 110. The height of the wall 412 extends the entire thickness of the dielectric layer 402. An additional dielectric layer 403 on the first dielectric layer 402 covers the driven element 410. A director element 420 is placed on the additional dielectric layer 402. The director element 420 is a circular conductive patterned structure that may have different dimensions (thickness and diameter) than the driven element 410. A circular conductive (e.g., metallic) wall 412 is also formed inside the additional dielectric layer 403 around and concentric with the director element 420. The height of the wall 412 extends the entire thickness of the additional dielectric layer 403. An additional director element 420 is placed on each of the additional dielectric layers 403 as shown. An additional conductive wall 412 is also formed around each director element 420 in the respective dielectric layer 403. The director elements 420 in the layers direct the radiation by the driven element 410 outside the antenna element 400.

The director elements 420 are positioned over the driven element 410, such that the centers of the director elements 420 and the driven element 410 are approximately aligned over one another. The elements are also positioned approximately concentrically with their surrounding circular walls. The walls and the directors are also aligned coaxially. The circular walls 412 may have different dimensions, such as different circular wall pattern diameters or wall heights. The edges of the walls 412 in consecutive dielectric layers are in contact with each other, as shown. As such, the walls 412 in the layers form a continuous structure surrounding the driven and director elements in the layers. The structure suppresses the surface or lateral waves radiated by the elements in the layers, thereby reducing side-lobes in the radiation pattern of the antenna element.

Figure 13A:
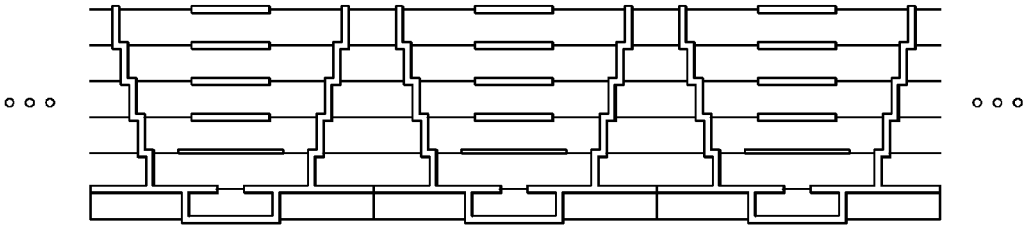
FIG. 13A shows cross-sectional side view of an embodiment of an array of antenna elements similar to the antenna element in FIG. 4.
Figure 13B:
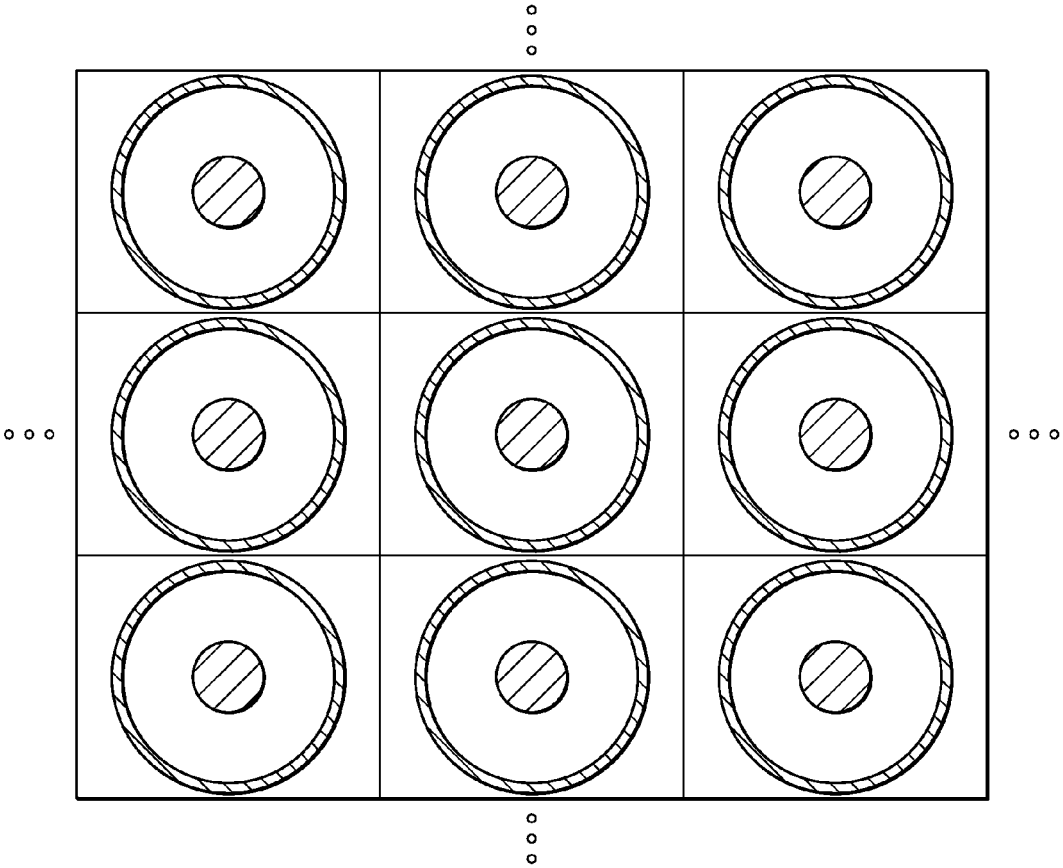
FIG. 13B shows a plan view of an embodiment of an array of antenna elements similar to the antenna element in FIG. 4.

In the case of an array of the antenna elements 400, suppressing the lateral waves reduces coupling between adjacent antenna elements and increases radiation efficiency in terms of gain in the intended direction (along the axis of the driven element and director elements). FIG. 13A shows a cross-sectional side view of an antenna structure as an array of antenna elements similar to the antenna element 400. FIG. 13B shows a plan view of the antenna array structure at the surface of the top dielectric layer of the antenna elements 400. In other embodiments, the driven/director elements and the surrounding walls can be elliptical instead of circular, or have other suitable geometries according to the antenna applications.

In the absence of the conductive walls around the driven and director elements, as in the case of antenna element 100, the radiation pattern includes more dispersed radiation in the lateral direction of the antenna, which results in larger side-lobes and reduces aperture efficiency. Further, in the case of an array of such antenna elements, the radiation in the lateral direction causes undesired coupling between the adjacent antenna elements and hence reduced gain. In contrast, the walls in the antenna element 400 reduce the propagation of surface or lateral waves within the layers, and hence more radiation energy is directed in the forward direction outside the antenna. This provides higher gain and radiation efficiency in the forward direction, also referred to herein as aperture efficiency.

Figure 6:
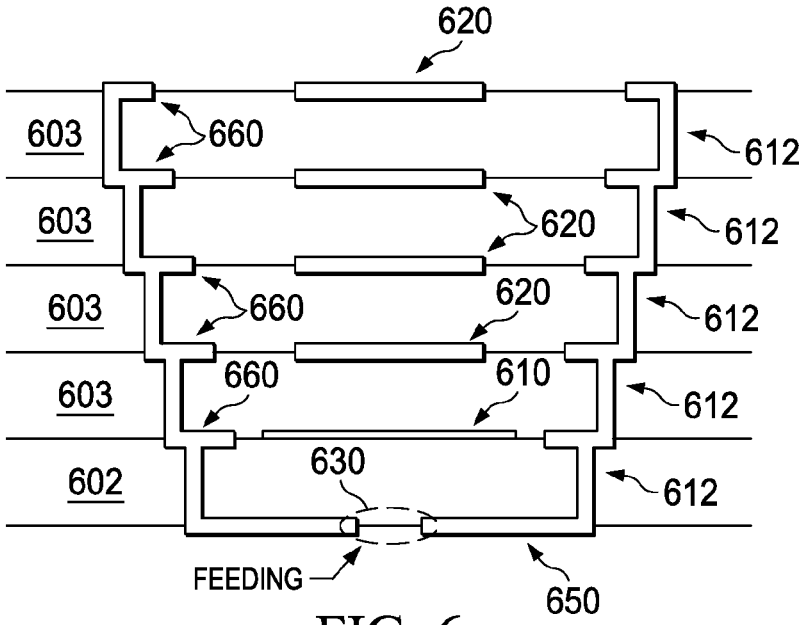
FIG. 6 shows a cross-sectional side view of an embodiment of a multi-layer antenna element with side-wall extensions.

FIG. 6 shows a cross-sectional side view of a multi-layer antenna element 600 according to another embodiment. The antenna element 600 includes a dielectric substrate (not shown) as a first bottom layer, a first dielectric layer 602 on the dielectric substrate, and four additional dielectric layers 603. A conductive (e.g., metallic) layer 650 shown at the bottom of the dielectric layer 602 covers a portion of the surface of the dielectric substrate. The antenna element also includes a slot 630 in the conductive layer 650, a driven element 610 on the dielectric layer 602, director elements 620 on respective additional dielectric layers 603, and conductive circular walls 612 surrounding the driven and conductor elements in their respective layers, as shown. The antenna element 600 also includes two feed lines inside the dielectric substrate (not shown) below the conductive layer 650. The components of the antenna element 600 are arranged similarly to their counterparts in the antenna element 400.

Additionally, the antenna element 600 includes side-wall extensions 660 that are protrusions at the edges of the circular walls 612 at each layer 602, 603 in a direction perpendicular to the walls. The side-wall extensions 660 extend around the wall circumferences inside the circular walls 612. The resulting circularly symmetrical patterns suppress the surface or lateral waves and resulting side-lobes, and reduce backward radiation in the layers. The walls 612 and the side-wall extensions 660 also form barriers that reduce backward radiation opposite to the intended direction for energy propagation (towards the top dielectric layer and outside the antenna). This efficiently supresses coupling between antenna elements in an array of antenna elements 600 and improves overall gain.

Figure 7:
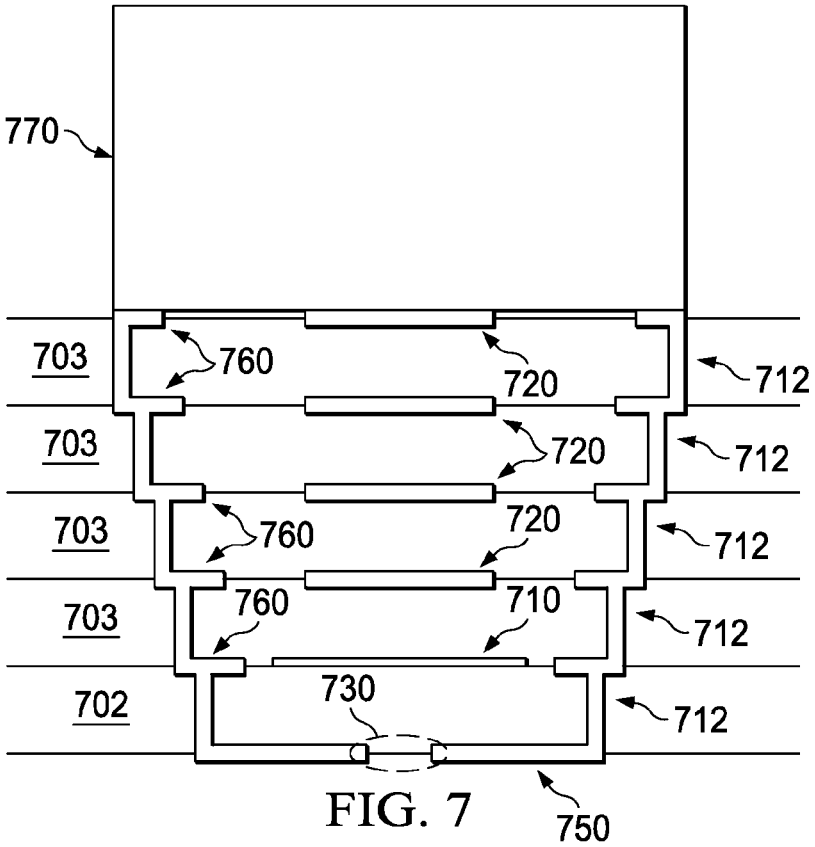
FIG. 7 shows a cross-sectional side view of an embodiment of a multi-layer antenna element including a dielectric resonator layer.

FIG. 7 shows a cross-sectional side view of a multi-layer antenna element 700 according to another embodiment. The antenna element 700 includes a dielectric substrate (not shown) as a first bottom layer, a first dielectric layer 702 on the dielectric substrate, and four additional dielectric layers 703. A conductive (e.g., metallic) layer 750 shown at the bottom of the dielectric layer 702 covers a portion of the surface of the dielectric substrate. The antenna element also includes a slot 730 in the conductive layer 750, a driven element 710 on the dielectric layer 702, director elements 720 on respective additional dielectric layers 703, conductive circular walls 712 surrounding the driven and conductor elements, and side-wall extensions 760 around the wall circumferences, as shown. The antenna element 700 also includes two feed lines inside the dielectric substrate (not shown) below the conductive layer 750. The components of the antenna element 700 above are arranged similar to their counterparts in the antenna element 600.

Additionally, a dielectric resonator layer 770 is placed on the top layer 703, over the driven element 720 and the side-wall extension 760. The thickness of the dielectric resonator layer 770 may be multiple times larger than the thicknesses of the dielectric layers 703, which produces a resonator effect that boosts the radiation energy propagating from the antenna element 700. The resonator effect allows multiple reflections of the waves in the vertical direction of the structure between the opposite surfaces of the dielectric resonator layer 770, which increases the radiation gain over a desired band. The geometry and surface area of the dielectric resonator layer 770 is chosen to optimize the radiation pattern and gain. For example, the dielectric resonator layer 770 may be a circular or elliptic cylinder. The diameter of the dielectric resonator layer 770 may be greater than or less than the diameters of the walls 712 in the layers.

Figure 8:
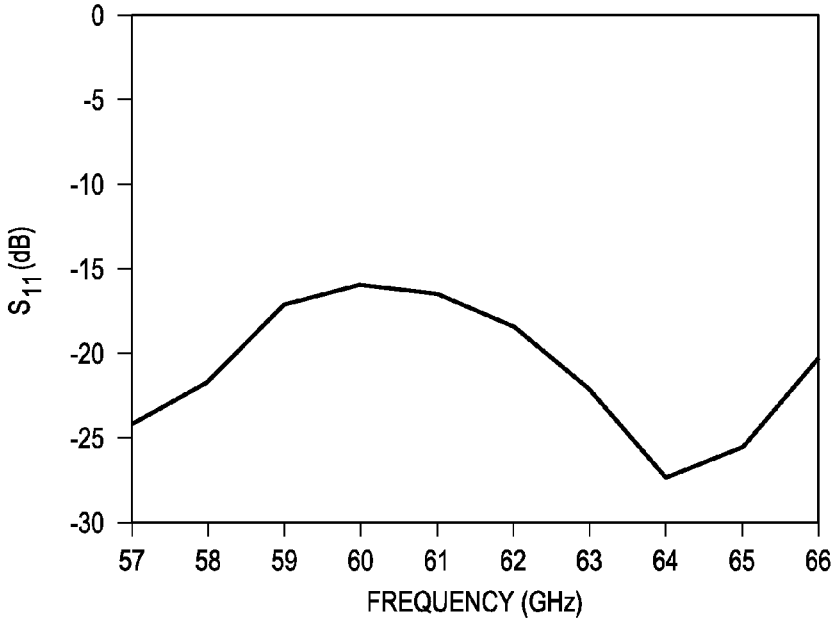
FIG. 8 is a plot of gain versus frequency in a vertical radiation plane of the antenna element in FIG. 7.
Figure 9:
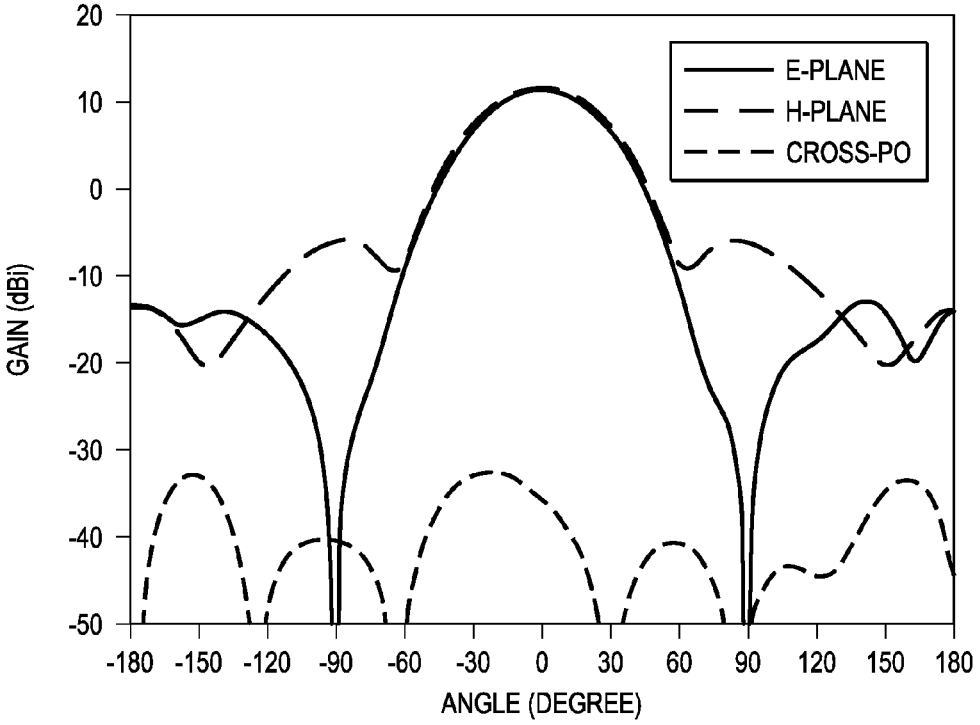
FIG. 9 is a plot of gain versus radiation angle for various polarization modes of radiation of the antenna element in FIG. 7.
Figure 10:
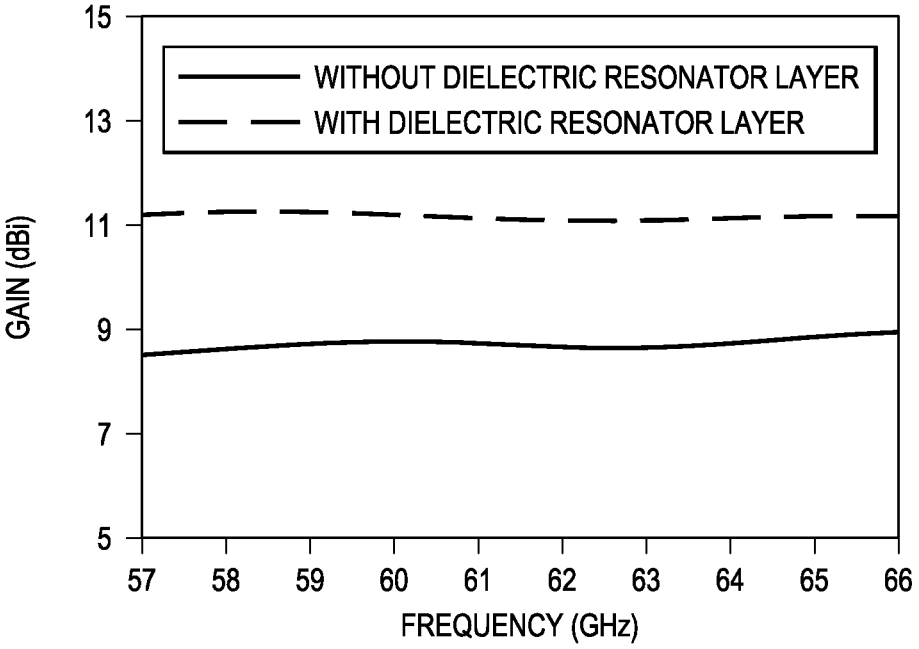
FIG. 10 is a plot of total gain versus frequency for antenna elements with and without a dielectric resonator layer.

FIG. 8 shows an example of gain (in dB) versus frequency (in GHz) behavior in a vertical radiation plane of the antenna element 700. Higher gain is achieved in the bandwidth of interest (e.g., 59 to 62 GHz) with respect to other frequency ranges. FIG. 9 shows an example of gain versus radiation angle behavior for various polarization modes (in E-plane, H-plane and cross-polarization) of the antenna element 700. The radiated energy is shown to be concentrated between −60 and 60 degrees in the forward direction from the antenna aperture. The radiation is suppressed or reduced at wider angles. FIG. 10 shows an example of total gain (in dBi) versus frequency behavior for the antenna element 700 with the dielectric resonator layer 770 and for the antenna element 600 without such layer. The antenna element 700 has higher gain than the antenna element 600 due to the resonance effect introduced by the dielectric resonator layer 770.

Figure 11:
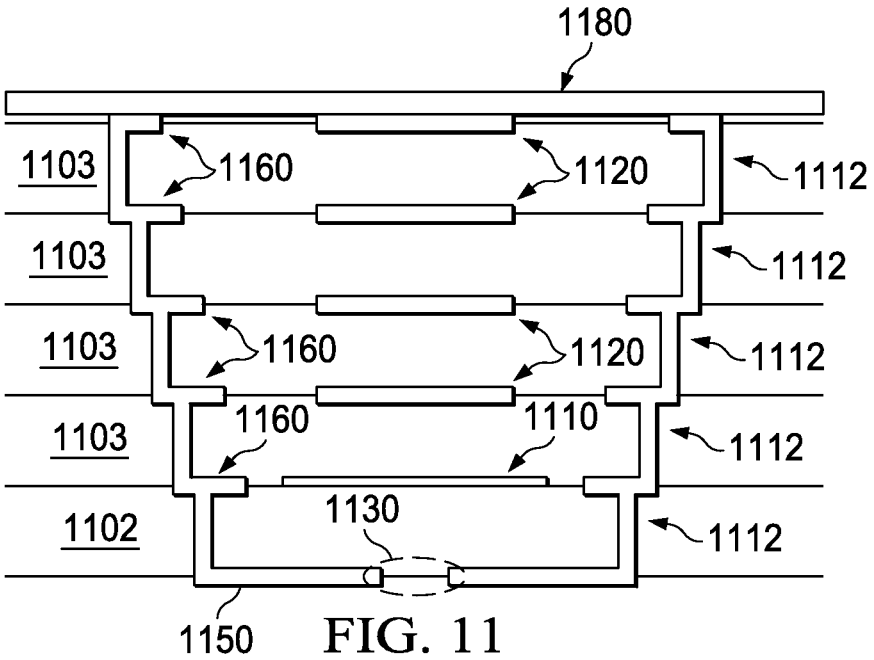
FIG. 11 shows a cross-sectional side view of an embodiment of a multi-layer antenna element with a high permittivity dielectric resonator layer.

FIG. 11 shows a cross-sectional side view of a multi-layer antenna element 1100 according to another embodiment. The antenna element 1100 includes a dielectric substrate (not shown) as a first bottom layer, a first dielectric layer 1102 on the dielectric substrate, and four additional dielectric layers 1103. A conductive (e.g., metallic) layer 1150 shown at the bottom of the dielectric layer 1102 covers a portion of the surface of the dielectric substrate. The antenna element also includes a slot 1130 in the conductive layer 1150, a driven element 1110 on the dielectric layer 1102, director elements 1120 on respective additional dielectric layers 1103, conductive circular walls 1112 surrounding the driven and conductor elements, and side-wall extensions 1160 around the wall circumferences, as shown. The antenna element 1100 also includes two feed lines inside the dielectric substrate (not shown) below the conductive layer 1150. The components of the antenna element 1100 above are arranged similarly to their counterparts in the antenna element 700.

Additionally, a relatively high permittivity layer 1170 is placed on the top layer 1103, over the driven element 1120 and the side-wall extension 1112. The layer 1170 has a permittivity higher than the permittivity of the other dielectric layers. In terms of wave propagation, a layer with such higher permittivity can be equivalent to a thicker dielectric layer with lower permittivity. Thus, the relatively high permittivity layer 1170 can introduce a similar resonator effect as the dielectric resonator layer 770, which boosts the radiation gain over a frequency band. The geometry and surface area of the high permittivity layer 1170 are chosen to optimize the radiation pattern and gain.

Figure 12:
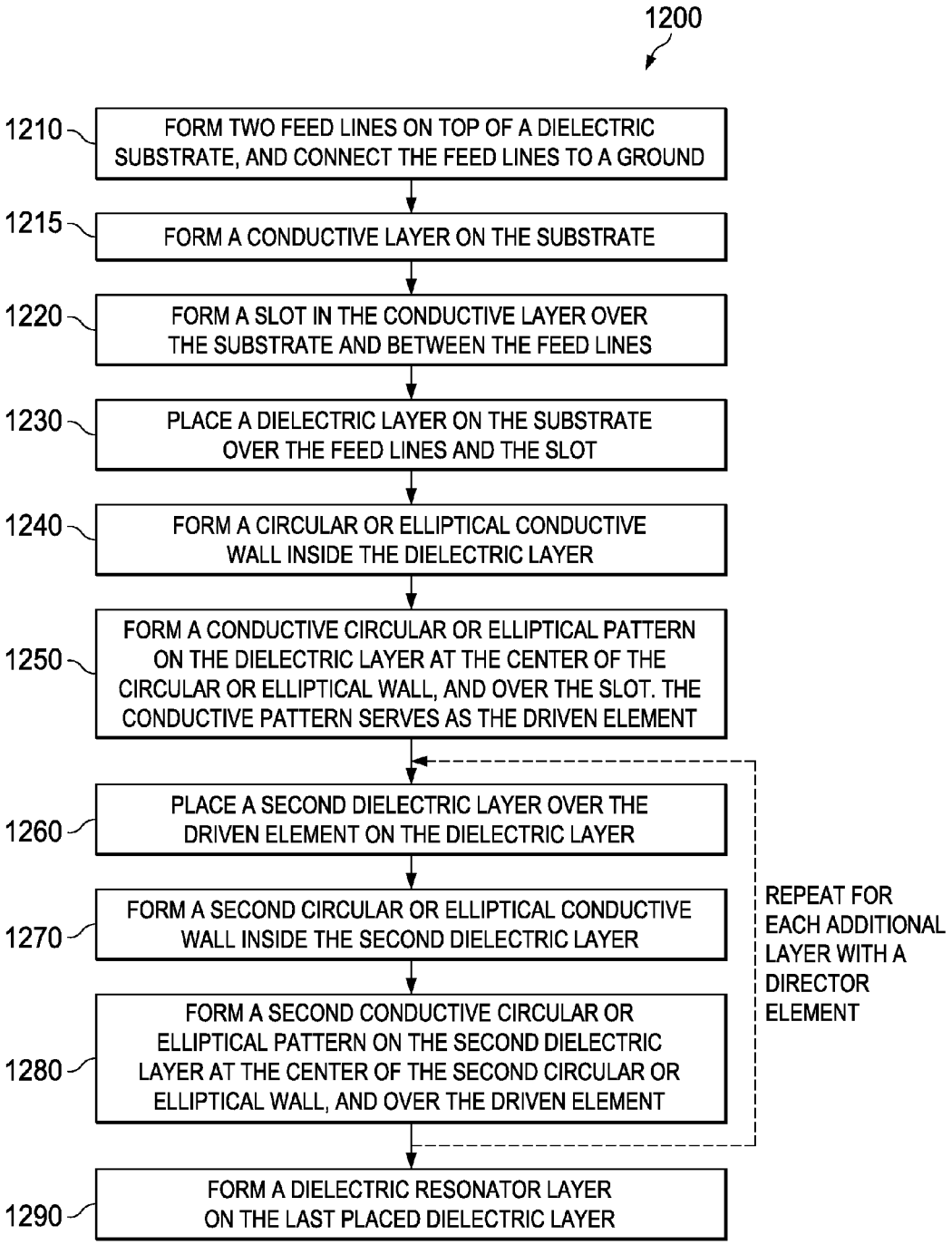
FIG. 12 shows a method for making a multi-layer antenna element according to an embodiment.

FIG. 12 shows an embodiment of a method 1200 for making a multi-layer antenna element, such as the antenna element 400, 600, 700 or 1100. At step 1210, two feed lines are formed in a dielectric substrate, e.g., by etching and metal deposition. The feed lines are connected to aground at the bottom of the substrate. At step 1215, a conductive (e.g., metal) layer is formed on the dielectric substrate, e.g., by deposition. At step 1220, a slot is formed in the conductive layer, e.g., by etching a portion of the conductive layer to expose the dielectric substrate between the two feed lines. The slot can be a rectangular slot oriented perpendicular to the direction of the feed lines. At step 1230, a dielectric layer is formed on the dielectric substrate, e.g., by deposition, over the feed lines and the slot. At step 1240, a circular or elliptical conductive wall is formed inside the dielectric layer, e.g. by etching and metal deposition. The wall height extends the entire thickness of the dielectric layer. At step 1250, a conductive circular or elliptical pattern is formed, e.g., by depositing and etching metal, on the dielectric layer, and is positioned at the center of the circular or elliptical wall and over the slot. The conductive pattern serves as the driven element. In an embodiment, the method includes an additional step of forming a side-wall extension around the top circumference of the wall on the dielectric layer. The side-wall extension surrounds the feeding element. At step 1260, a second dielectric layer is placed, e.g., by deposition, over the driven element on the dielectric layer. At step 1270, a second conductive circular or elliptical wall is formed inside the second dielectric element, e.g. by etching and metal deposition. The second wall height extends the entire thickness of the second dielectric layer. The centers of the second wall in the second layer and the wall in the layer beneath it are aligned with the feeding element. At step 1280, a second conductive circular or elliptical pattern is formed, e.g., by depositing and etching metal, on the second dielectric layer and is positioned in the center of the second wall over the feeding element. The second pattern serves as a director element. In an optional step, a side-wall extension is formed around the top circumference of the second wall on the second dielectric layer. The side-wall extension surrounds the director element. The steps 1260 to 1280 are repeated for each additional layer with a director element.

The thicknesses of the layers, the sizes and geometries of the conductive patterns (feeding and director elements) and the walls can be designed to optimize antenna radiation criteria, as described above. At step 1290, a dielectric resonator layer is placed on the last placed dielectric layer. The steps above may be repeated to form each antenna element in an array of such elements.

While several embodiments have been provided in the present disclosure, it should be understood that the disclosed systems and methods might be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted, or not implemented.

In addition, techniques, systems, subsystems, and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise. Other examples of changes, substitutions, and alterations are ascertainable by one skilled in the art and could be made without departing from the spirit and scope disclosed herein.

What is claimed is:

1. An antenna element structure comprising:
- a dielectric substrate;
- a conductive layer on the dielectric substrate;
- two feed lines inside the dielectric substrate, the two feed lines in contact with the conductive layer;
- a slot in the conductive layer exposing a surface of the dielectric substrate, the slot positioned between the two feed lines;
- at least two dielectric layers on the dielectric substrate;
- a conductive element on each dielectric layer, the conductive element positioned over the slot and between the feed lines; and
- a conductive wall inside each dielectric layer and surrounding the conductive element.

2. The antenna element structure of claim 1, wherein the conductive walls in each dielectric layer are in contact with each other.

3. The antenna element structure of claim 1, wherein the conductive wall in a first dielectric layer on top of the dielectric substrate is in contact with the conductive layer on the dielectric substrate.

4. The antenna element structure of claim 1, wherein the conductive element on a first dielectric layer on top of the dielectric substrate is a driven element.

5. The antenna element structure of claim 1 further comprising on each dielectric layer, a side-wall extension around a circumference of the conductive wall, the side-wall extension perpendicular to the conductive wall and surrounding the conductive element on the dielectric layer.

6. The antenna element structure of claim 5, wherein the side-wall extension extends inside the circumference of the conductive wall.

7. The antenna element structure of claim 1 further comprising a dielectric resonator layer on a top dielectric layer.

8. The antenna element structure of claim 7, wherein the dielectric resonator layer has a thickness multiple times larger than a thickness of the dielectric layers.

9. The antenna element structure of claim 7, wherein the dielectric resonator layer has a permittivity higher than a permittivity of the dielectric layers.

10. The antenna element structure of claim 1, wherein the conductive wall in each dielectric layer has a height extending an entire thickness of the dielectric layer.

11. The antenna element structure of claim 1, wherein the conductive element on each dielectric layer is positioned concentrically with the conductive wall in the dielectric layer.

12. The antenna element structure of claim 11, wherein the conductive walls in each second dielectric layer are aligned coaxially with the conductive elements.

13. The antenna element structure of claim 1, wherein the conductive elements and the conductive walls are circular.

14. The antenna element structure of claim 1, wherein the conductive elements and the conductive walls are elliptical.

15. The antenna element structure of claim 1, wherein the slot is a rectangular slot oriented in a direction perpendicular to the two feed lines.

16. An antenna array structure comprising:
- a dielectric substrate;
- an array of adjacent antenna elements on the dielectric substrate, each antenna elements comprising:
  - a conductive layer on the dielectric substrate;
  - two feed lines inside the dielectric substrate, the two feed lines in contact with the conductive layer;
  - a slot in the conductive layer exposing a surface of the dielectric substrate, the slot positioned between the two feed lines;
  - at least two dielectric layers on the dielectric substrate;
  - a conductive element on each dielectric layer, the conductive element positioned over the slot and between the feed lines; and
  - a conductive wall inside each dielectric layer and surrounding the conductive element, the conductive wall having a height equal to a thickness of the dielectric layer.

17. The antenna array structure of claim 16, wherein each antenna element further comprises:
- on each dielectric layer, a side-wall extension around a circumference of the conductive wall, the side-wall extension perpendicular to the conductive wall and surrounding the conductive element on the dielectric layer.

18. The antenna array structure of claim 16, wherein the conductive walls in each dielectric layer have different diameters.

19. A method for making an antenna element, the method comprising:
- forming a conductive layer on a dielectric substrate;
- forming a slot in the conductive layer, the slot exposing the dielectric substrate;
- forming two feed lines inside the dielectric substrate;
- placing at least two dielectric layers on the dielectric substrate and;
- forming, inside each dielectric layer, a circular or elliptical conductive wall; and
- forming a conductive element on each dielectric layer and over the slot.

20. The method of claim 19 further comprising forming, on each dielectric layer, a side-wall extension around a circumference of the circular or elliptical conductive wall, the side-wall extension perpendicular to the circular or elliptical conductive wall.

21. The method of claim 19 further comprising forming a dielectric resonator layer on a top dielectric layer.

* * * * *